US007686684B2

(12) United States Patent
Schlau

(10) Patent No.: US 7,686,684 B2
(45) Date of Patent: Mar. 30, 2010

(54) LOTTERY BASED ENTERTAINMENT SYSTEM

(76) Inventor: Michael James Schlau, 1713 Waterville La., Schaumburg, IL (US) 60194

( * ) Notice: Subject to any disclaimer, the term of this patent is extended or adjusted under 35 U.S.C. 154(b) by 612 days.

(21) Appl. No.: 11/708,511

(22) Filed: Feb. 21, 2007

(65) Prior Publication Data

US 2008/0220842 A1 Sep. 11, 2008

(51) Int. Cl.
*A63F 9/24* (2006.01)

(52) U.S. Cl. ..... 463/17; 463/16; 463/18; 463/19; 463/25

(58) Field of Classification Search ..... 463/16, 463/17, 18, 19, 25
See application file for complete search history.

(56) References Cited

U.S. PATENT DOCUMENTS

2003/0199313 A1* 10/2003 Gonen et al. ..... 463/25
2005/0043094 A1* 2/2005 Nguyen et al. ..... 463/42
2005/0250573 A1* 11/2005 Kane et al. ..... 463/17
2007/0117637 A1* 5/2007 Morgan et al. ..... 463/43
2007/0142108 A1* 6/2007 Linard et al. ..... 463/22

* cited by examiner

*Primary Examiner*—James S McClellan
*Assistant Examiner*—Brandon Gray
(74) *Attorney, Agent, or Firm*—Justin Lampel

(57) ABSTRACT

The present invention generally provides a sequential method for producing and/or casting a film, television, play or other form of entertainment. More specifically, a lottery based system is implemented so that the winning person obtains rights to be a subject in a play, television show, film or other form of entertainment. The winning person may actually act in the project or the winning person may elect to have an actor play him or her in the project. Audience members who obtain tickets to showings of the project are themselves given a lottery ticket to obtain the rights to be a subject in a subsequent play, television show or film. Further, the winning audience member may also obtain a prize, such as cash, for winning the lottery. The process repeats itself so that a subject of each new project is taken from the audience of the previous project. The cycle may continue until future audiences no longer support the running project.

10 Claims, 1 Drawing Sheet

LOTTERY BASED ENTERTAINMENT SYSTEM

BACKGROUND OF THE INVENTION

The present invention generally provides a sequential method for producing and/or casting a film, television, play or other form of entertainment. More specifically, a lottery (or raffle) based system is implemented so that the winning person obtains rights to be a subject in a play, television show, film or other form of entertainment. The winning person may actually act in the project or the winning person may elect to have an actor play him or her in the project. Alternatively, the winning person may receive a prize such as, for example, a cash prize. Audience members who obtain tickets to showings of the project are themselves given a lottery ticket to obtain the rights to be a subject in a subsequent play, television show or film. Further, the winning audience member may also obtain a prize, such as cash, for winning the lottery. The process repeats itself so that a subject of each new project is taken from the audience of the previous project. The cycle may continue for a set amount of time, a set amount of cycles or future audiences no longer support the running project. It should be noted that the audience member need not be present to win in some embodiments of the method.

The entertainment industry is one of the most competitive industries in the country. Millions of hopeful actors fearlessly audition on a daily basis to become the next big television or film star. Those auditions are held by thousands of independent producers and studio executives who are themselves fearlessly fighting to win an audience for their next project.

In order to win the audience the producers must offer a unique product. Although largely saturated at this time, reality based entertainment is one of the biggest audience magnets. Reality television programs such as American Idol, Survivor and Big Brother are just a few examples of the highly successful reality programming boom. Typically, contestants on these programs undergo an "audition" process to narrow the field of possible contestants to a manageable few. The audition process often includes live and/or video tape auditions. Many of these projects also include an at home audience voting segment whereby the audience chooses a winner based on talent, personality or other factors.

The gambling industry is one of the largest growing industries in the country next to the entertainment industry. In fact the two are often combined. Las Vegas is ever expanding and riverboats are growing steadily in number. As of yet there exists no known lottery system wherein the winner has the opportunity to star in (or be the subject of) a film, play, television show or other form of entertainment.

A need, therefore, exists for an improved lottery based system wherein an admission ticket also acts as a lottery ticket. Further, no known lottery based casting system exists wherein the winner has the opportunity to star in (or be the subject of) a film, play, television show or other form of entertainment.

SUMMARY OF THE INVENTION

The present invention generally provides a sequential method for producing and/or casting a film, television, play or other form of entertainment. More specifically, a lottery based system is implemented so that the winning person obtains rights to be a subject in a play, television show, film or other form of entertainment. The winning person may actually act in the project or the winning person may elect to have an actor play him or her in the project. Audience members who obtain tickets to showings of the project are themselves given a lottery ticket to obtain the rights to be a subject in a subsequent play, television show or film. Further, the winning audience member may also obtain a prize, such as cash, for winning the lottery. The process repeats itself so that a subject of each new project is taken from the audience of the previous project. The cycle may continue until future audiences no longer support the running project.

Audience members obtaining a lottery ticket may purchase the ticket or may, in some cases, receive a free entry by contacting the producers via a predetermined manner, as state law may dictate. The ticket may contain a designator of authenticity and a code to help eliminate fraud. For example, the ticket may include scratch off portion and or a hologram.

In an embodiment, a method for conducting a lottery includes the steps of: providing a plurality of lottery tickets to individuals wherein the lottery tickets act as admission to a first film, play, television show or other entertainment; selecting at least one winning lottery ticket; placing at least one the winners of the first lottery in an acting role in a second film, play, television show or other form of entertainment; and providing a second plurality of lottery tickets to individuals wherein the second plurality a lottery tickets acts as admission to the second film, play, television show or other form of entertainment and wherein a subsequent prize is provided to the winner of the second lottery.

In yet another embodiment of the method, no purchase is required to be entered into the lottery.

In still another embodiment of the method, an authenticator code is provided on the lottery ticket.

And in another embodiment, the lottery is televised.

In yet another embodiment of the method, admission tickets are provided to the first and/or second film, play, television show or other form of entertainment wherein the admission tickets are not lottery tickets.

In another embodiment, a method for conducting a lottery includes the steps of: providing a plurality of lottery tickets to individuals wherein the lottery tickets act as admission to a first film, play, television show or other entertainment; selecting at least one winning lottery ticket; producing a second film, play, television show or other form of entertainment wherein the second film, play, television show or other form of entertainment is at least partly based on the life of at least one the winners of the first lottery; and providing a second plurality of lottery tickets to individuals wherein the second plurality a lottery tickets acts as admission to the second film, play, television show or other form of entertainment.

For a more complete understanding of the above listed features and advantages of the present method for a lottery based system reference should be made to the accompanying drawings. Further, additional features and advantages of the present invention are described in, and will be apparent from, the detailed description of the preferred embodiments and from the drawings.

DETAILED DESCRIPTION OF THE PREFERRED EMBODIMENTS

Figure 1:
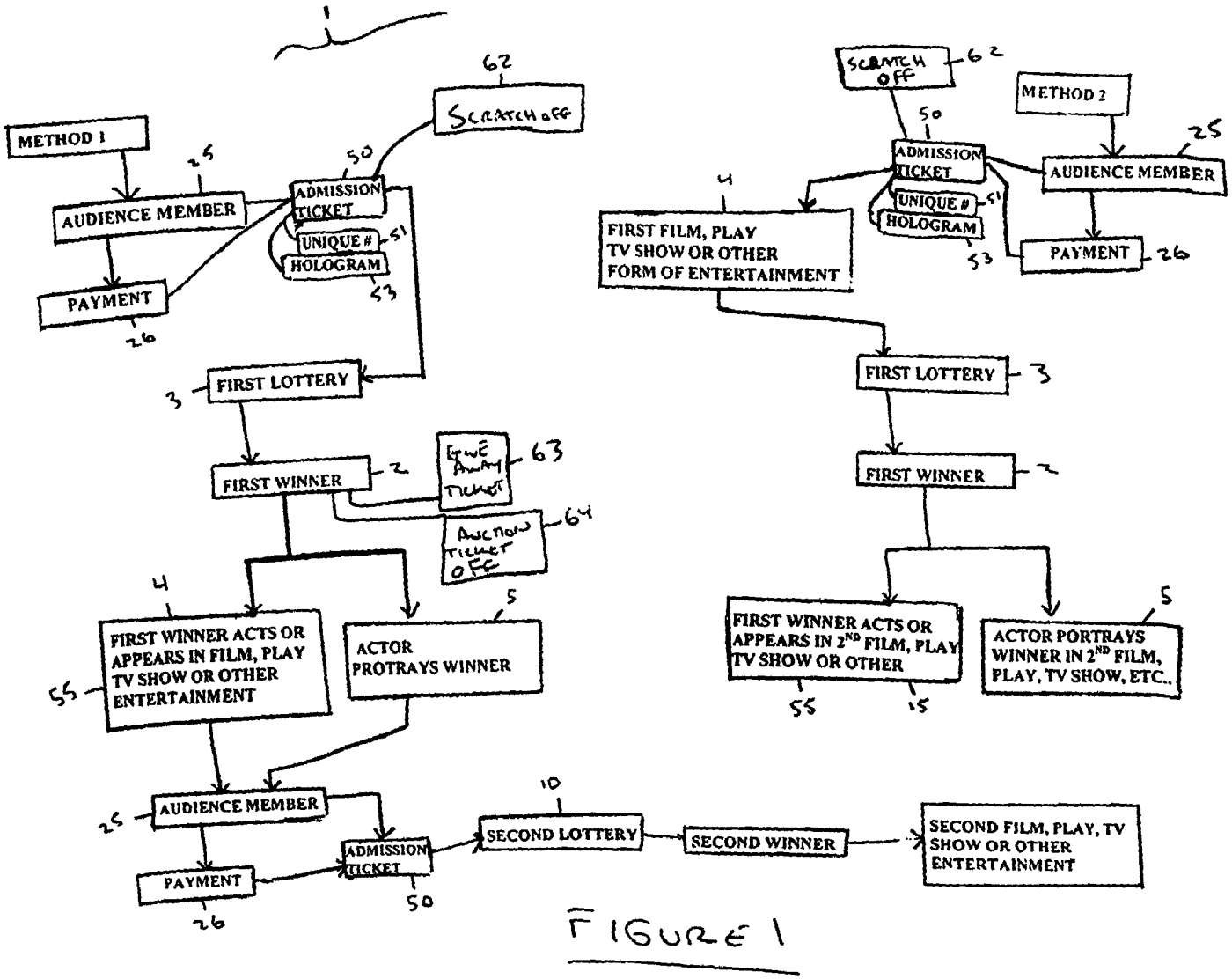
FIG. 1 illustrates a flow chart of the sequential lottery based entertainment system.

Referring now to the drawings wherein like numerals refer to like parts, FIG. 1 illustrates a flow chart of the sequential lottery based entertainment system 1. As previously indicated, the present invention relates to a method for conducting a sequential lottery based entertainment system 1 wherein a first winner 2 of a first lottery 3 is given the opportunity to act in a film, play, television show or other form of entertainment 4. Alternatively, the first winner 2 of the first lottery 3 may elect to have an actor 5 portray him or her in the film, play, television show or other form of entertainment 4. The first lottery 3 may take place before the first film, play, television show or other form of entertainment 4 or the first lottery 3 may take place after the first film, play, television show or other form of entertainment 4. In some embodiments, the subject of the film, play, television show or other form of entertainment 4 may be the first lottery 3 and any events surrounding the first lottery 3. In some embodiments, the film, play, television show or other form of entertainment 4 may be a documentary or a dramatization of the first lottery 3 and or the events surrounding the first lottery 3.

A second lottery 10 may be held after the first lottery 3. More specifically, the second lottery 10 may be held after the release of the first film, play, television show or other form of entertainment 4. In an embodiment, audience members 25 of the first film, play, television show or other form of entertainment 4 would pay 26 for an admission ticket 50 to see the first film, play, television show or other form of entertainment 4. The admission ticket 50 would have a unique number 51 and an authenticating device, such as, for example, a hologram 53, or other device commonly used in the lottery industry. In addition, the admission ticket 50 may have a scratch off portion 62 offering a possible additional prize. Because the laws of some states require that free entries be provided to the public if a game of chance is conducted with a prize, the current method may allow the public to obtain the admission ticket 50 for free. In some embodiments the audience member 25 would not be required to view the actual film, play, television show or other form of entertainment 4, but may simply only be required to possess the winning admission ticket 50.

The second lottery 10 may be held for audience members 25 of the first film, play, television show or other form of entertainment 4. The winning audience member 25 in possession of the authenticated admission ticket 50 may win, for example, the right to later act 55 in (or have an actor 5 portray him or her) in a second play, film, television show or other form of entertainment 15. The process may then repeat itself until the audience 25 interest drops off. The lottery 3 of each of the projects are generally held after the release of the film, play, television show or other form of entertainment 4. Preferably, the lottery 3 is held on a live television broadcast.

The winning audience member 25 may also win the right to produce a film, play, television show or other form of entertainment 4. More specifically, winning audience member 25 may have the right to determine the subject of a subsequent film and may, for example, help with the casting of the film.

The winner 2 of the first lottery 3 may elect to transfer rights to act in and/or be the subject of the second lottery 10. More specifically, the winner 2 of the first lottery 3 may elect to give away 63 the rights of the winning admission ticket 50 to, for example, a friend, family member or the like. Further, the winner 2 of the first lottery 3 may elect to sell the winning admission ticket 50 through, for example, a website auction 64. The website auction 64 may be set up by the entity controlling the lottery. The process may repeat itself so that, for example, the winner 2 of a fifth lottery may transfer rights to act in and/or be the subject of the sixth production.

If the lottery 3 is for a film, the audience members 25 may, in some cases, purchase the admission ticket 50 at a local theater. In such cases, the admission ticket 50 may be purchased by the same clerk selling admission tickets to other films. In some states it may be required to restrict the purchase of the admission ticket 50 to people under a certain age, which is usually eighteen. In these cases the movie theater may sell a non-lottery ticket movie ticket to the underage person whereby the underage person may attend the movie, but would not be issued an admission ticket 50 having a lottery 3 number.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

The invention claimed is:

1. A method for conducting a lottery including the steps of:

providing a first plurality of lottery tickets to individuals wherein the first plurality of lottery tickets act as admission to a first film, play, or television show;

selecting at least one winning lottery ticket from the first plurality of lottery tickets that indicates a corresponding at least one winner of a first lottery;

placing at least one of the winners of the first lottery in an acting role in a second film, play, or television show; or allowing the at least one winner of the first lottery to produce the second film, play, or television show; if the at least one winner of the first lottery selects not to personally accept an acting role or a producing role in the second film, play or television show; allowing the at least one winner of the first lottery to sell their winning lottery ticket to another individual through a website auction; and providing a second plurality of lottery tickets to individuals wherein the second plurality a lottery tickets act as admission to the second film, play, or television show and wherein a subsequent prize is provided to the winner of a second lottery.

2. The method of claim 1 wherein the subsequent prize is an acting or producing role in a film, play or television show.

3. The method of claim 1 wherein no purchase is required to be entered into the lottery.

4. The method of claim 1 further comprising the step of providing an authenticator code on each of the plurality of first and second lottery tickets.

5. The method of claim 1 further comprising the step of televising the lottery.

6. The method of claim 1 further comprising the step of providing admission tickets to the first and/or second film, play or television show wherein the admission tickets are not lottery tickets.

7. The method of claim 1 further providing the step of providing cash to the at least one of the winners of the first and second lotteries.

8. The method of claim 1 further comprising the step of: continuing a cycle of providing a plurality of subsequent lottery tickets wherein the subsequent lottery tickets act as admissions to a subsequent film, play or television show and wherein a subsequent winner is chosen from the plurality of subsequent lottery tickets and wherein the subsequent winner acts in or produces an additional film, play or television show wherein the cycle continues for a predetermined amount of time.

9. The method of claim 1 further providing the step of: providing a scratch-off portion on the first and second plurality of lottery tickets wherein the scratch-off portion may provide a prize.

10. A method for conducting a lottery including the steps of:

providing a first plurality of lottery tickets to individuals wherein the first plurality of lottery tickets act as admission to a first film, play, or television show;

selecting at least one winning lottery ticket from the first plurality of lottery tickets that indicates a corresponding at least one winner of a first lottery;

producing a second film, play, or television show wherein the second film, play, or television show is at least based on the life of at least one of the winners of the first lottery; and if the at least one winner of the first lottery selects not to personally accept producing the second film, play or television show based on at least the life of the at least one of the winner of the first lottery, allowing the at least one winner of the first lottery to sell their winning lottery ticket to another individual through a website auction;

providing a second plurality of lottery tickets to individuals wherein the second plurality a lottery tickets acts as admission to the second film, play, or television show.

* * * * *